US009007276B2

(12) United States Patent
Locatori

(10) Patent No.: US 9,007,276 B2
(45) Date of Patent: Apr. 14, 2015

(54) THREE-AXES AERIAL DISH POINTING DEVICE WITH MINIMUM RADOME ENCUMBRANCE

(76) Inventor: Brunello Locatori, Camaiore (IT)

( * ) Notice: Subject to any disclaimer, the term of this patent is extended or adjusted under 35 U.S.C. 154(b) by 757 days.

(21) Appl. No.: 13/142,435

(22) PCT Filed: Jan. 4, 2010

(86) PCT No.: PCT/EP2010/000007

§ 371 (c)(1),
(2), (4) Date: Jul. 19, 2011

(87) PCT Pub. No.: WO2010/076336

PCT Pub. Date: Jul. 8, 2010

(65) Prior Publication Data

US 2011/0267255 A1 Nov. 3, 2011

(30) Foreign Application Priority Data

Jan. 2, 2009 (IT) ..... PI2009A0001

(51) Int. Cl.

| | |
|---|---|
| ***H01Q 1/42*** | (2006.01) |
| ***H01Q 1/18*** | (2006.01) |
| ***H01Q 1/34*** | (2006.01) |
| ***H01Q 3/08*** | (2006.01) |
| ***H01Q 19/13*** | (2006.01) |

(52) U.S. Cl.

CPC . *H01Q 3/08* (2013.01); *H01Q 1/18* (2013.01); *H01Q 1/34* (2013.01); *H01Q 1/42* (2013.01); *H01Q 19/13* (2013.01)

(58) Field of Classification Search

USPC ..... 343/757, 765, 840, 872

See application file for complete search history.

(56) References Cited

U.S. PATENT DOCUMENTS

| | | | | |
|---|---|---|---|---|
| 2003/0058179 | A1 | 3/2003 | Desargant et al. | |
| 2003/0214449 | A1 * | 11/2003 | King | 343/757 |
| 2008/0297427 | A1 | 12/2008 | Jung et al. | |

FOREIGN PATENT DOCUMENTS

| | | |
|---|---|---|
| JP | 60-191502 | 9/1985 |
| JP | 61-126803 | 6/1986 |
| JP | 2008-219233 | 9/2008 |

* cited by examiner

*Primary Examiner* — Karl D Frech

(74) *Attorney, Agent, or Firm* — Ladas & Parry LLP

(57) ABSTRACT

A pointing device for real-time pointing the dish of a dish antenna (1), in particular a marine dish antenna, to be housed within a radome (21). The antenna comprises a dish (3) and a dish position adjusting means that achieves adjusting motions about an azimuth axis (6), an elevation axis (7) and a skew axis (8), the axes (6,7,8) having a minimum distance from a reference point (12), preferably the centre point (13) of a domed portion (22) of radome (21), wherein the reference point (12) is located closer to the front side (14) of the dish than to the rear side (15) of it, and wherein the dish position adjusting means comprises a driving actuating portion (27) integral to the support (2) and a driven actuating portion (28) integral to the dish (3) are provided which cooperate with each other to actuate the rotation about the skew axis (8), the driven actuating portion (28) extending within the profile of the dish (3). This way, the adjusting motions are carried out defining a substantially spherical space portion (26), whereby it is possible to house the dish antenna (1), in particular a Cassegrain type dish antenna, in radome whose diameter is smaller with respect to radome-housed dish antennas that are equipped with prior art pointing devices.

14 Claims, 11 Drawing Sheets

THREE-AXES AERIAL DISH POINTING DEVICE WITH MINIMUM RADOME ENCUMBRANCE

FIELD OF THE INVENTION

The present invention relates to a device for moving an aerial dish according to three rotational axes, in particular a marine satellite aerial dish.

STATE OF THE ART—TECHNICAL PROBLEM

Dish antennas are normally equipped with a manual or preferably an automatic device for pointing the dish towards a desired satellite. If the dish has to be installed on a vehicle, in particular a watercraft, a pointing device must be provided which is suitable for carrying out a substantially real-time movement of the dish, corresponding to each movement of the vehicle, to keep on the communication.

A dish orientation can be defined by three angles:

- the azimuth angle, which is formed between a pointing axis of the dish and a prefixed reference cardinal direction, an azimuth angle change being defined by a rotation about an azimuth axis;
- the elevation angle, which is formed between the pointing axis and a predetermined line that lies on a plane defined by the pointing axis and by the azimuth axis, an elevation angle change being defined by a rotation about an elevation axis;
- the skew angle, which is formed between a line that is integral to the dish and a line that is integral to a support of the dish.

Azimuth and elevation angle are defined responsive to the position of the emitter/receiver of the signal received/sent by the dish antenna, for example a satellite, with respect to the antenna itself. Therefore, a two-axes device could be enough to properly point a grounded dish antenna towards an emitter/receiver, in particular a broadcasting satellite, selected by a satellite receiver system. However, marine dish antennas need an instantaneous arrangement of the dish in such a way that the roll and pitch oscillatory motions, which are caused by the waves, can be instantaneously compensated, and the position of the broadcasting satellite may oscillate much. For this reason, a dish antenna to be used on a vehicle, in particular a watercraft, the need is felt of adjusting in real-time the dish according to all the three above-mentioned angles, i.e. including also the skew angle.

Marine satellite dishes are usually provided with radomes, i.e. weatherproof enclosures that protect the aerials and their local electronics from the environment, in particular, from moisture corrosion.

Devices are known that are suitable for substantially real-time pointing a dish antenna, in particular a marine satellite dish, moving it about two or three axes, each of these axes corresponding to one of the above-mentioned angles. Such a device is described, for instance, in PCT application No. WO2007/067016. This document, however, is silent on the use of any radome about the dish.

Prior art pointing devices require a wide clearance from the radome internal surface, to properly carry out the adjusting motion of the dish; therefore a large size radome is needed, with respect to the dish overall dimensions. Common commercial satellite systems have a radome-to-dish diameter ratio which normally ranges between 1.25 and 1.5, the smaller the dish, the higher the ratio; for example, a 60 cm diameter dish antenna requires, according to the known art, an inner diameter radome about 87÷90 cm, while an 180÷195 inner diameter radome must be provided for a 150 cm diameter dish.

A large radome often makes it difficult and expensive to install the whole aerial. Moreover, stability problems may also occur due to strong wind exposure, as well as passengers and crew space reduction and movement hindrance arise.

Furthermore, poor received signals quality may result from a large radome at some dish orientations, since wave attenuation and aberration is likely to occur due to misalignment between wave direction and radome surface normal direction, as well as dish reception/transmission lobe distortion.

Some attempts have been made to reduce the space region occupied by a dish antenna when rotating it about the three above-mentioned axes. In particular, JP2008219233 describes an antenna device comprising an elevation rotary structural section, a cross-elevation rotary structural section and an azimuth rotary structural section for rotating the dish, respectively, about an elevation axis, a cross-elevation, i.e. a skew axis, and an azimuth axis, said axes crossing at a point in order to obtain a compact antenna. The rotation about skew axis is obtained by rotatably arranging an external gear of the elevation rotary structural section inside an internal gear of the cross elevation rotary structural section, an annular member whose thickness contributes to overall aerial encumbrance; accordingly, such a device fails to significantly reduce the radome dimension. Moreover, instability problems are likely to arise due to the particular cross elevation rotary structural section arrangement.

Another device that aims at reducing the dish antenna turning radius and radome dimensions is disclosed in JP61126803. Even in this case, a dish position adjusting means is used in which the three axes are crossed at a point, or approach together: a first and a second shaft, which correspond to elevation and tilt (skew) axes, are coaxially arranged, while the shaft corresponding to a third (azimuth) axis is arranged perpendicularly to first and second axis in such a way that the centre of the corresponding rotation is places at the centre of skew rotation, which is therefore a point common or very close to each axis. Such a dish position adjusting means is positioned behind the dish with respect to its concave side, which makes it impossible to arrange such antenna components as the OMT (Ortho Mode Transducer) and the LNB (Low-noise Block Converter) behind the dish, as in the case of a Cassegrain dish antenna. A frontal arrangement of OMT and LNB would require cabling moving components, which means higher construction and maintenance costs; such an arrangement would also lead to a lower signal quality and to practical impossibility to exploit Ku/Ka dual band systems. Such systems are necessary to make a Vsat antenna, i.e. a relatively small antenna that is suitable for providing a plurality of services as internet, TV etc.

A further device based on the principle of crossing at a point or approaching tuning axes is described in JP60191502, however such a device concerns two-axes systems only.

SUMMARY OF THE INVENTION

It is therefore an object of the present invention to provide a dish antenna pointing device, in particular a marine satellite dish pointing device, that allows moving the dish about three axes, such that respective dish movements can be actuated according to an azimuth angle, an elevation angle, and a skew angle, and that requires a radome that is smaller than radome that are in use with prior art dish antennas, i.e. dish antennas that are provided with prior art pointing devices.

A particular object of the present invention is to provide such a dish antenna pointing device, whose position does not interfere with the typical position of such feed component as OMT and LNB in a Cassegrain type dish antenna.

Another particular object of the present invention is to provide such a dish antenna pointing device, which easily arranges dual feed components, in particular Ku/Ka dual feed components, as required by versatile Vsat systems.

It is also an object of the present invention is to provide such a dish antenna pointing device, that allows a smooth, regular and stable adjusting motion.

Under a different viewpoint, an object of the invention is to provide a kit comprising a dish antenna and a radome, in which a gap is left between radome inner wall and dish maximum diameter, said gap narrower than in prior art dish antenna-radome kits.

It is still an object of the present invention to provide such a kit, in which signal attenuation and aberration are less important and in which the antenna lobe is less affected by the radome than in prior art dish antenna-radome kits.

These and other objects are achieved by a pointing device for pointing a dish of a dish antenna in a desired pointing position, the dish having a rear side, a front side that in use is directed towards a remote receiver/sender according to a pointing axis, the dish antenna comprising a radome that has a domed portion with a predetermined diameter such that the dish is contained within the radome in any pointing position of the dish, the pointing device comprising:

an azimuth axis adjustment means, for rotation of the dish about an azimuth axis to adjust an azimuth angle formed between the pointing axis and a prefixed reference cardinal direction;

an elevation axis adjustment means, for rotation of the dish about an elevation axis to adjust an elevation angle formed between the pointing axis and a predetermined line that lies on a plane defined by the pointing axis and by the azimuth axis;

a skew axis adjustment means, for rotation of the dish about a skew axis, to adjust a skew angle formed between a dish transverse axis and a support transverse axis of a support of the dish;

the main feature of such pointing device is that the azimuth axis, the elevation axis and the skew axis have respective distances from a reference point, such that during an adjusting motion by any of the adjustment means the dish defines a portion of a space region that is contained within the radome, wherein the reference point is located closer to the front side than to the rear side opposite to the front side, such that the distance between the dish and the radome is less than a determined distance S for any pointing position.

Advantageously, the radome comprises a domed portion, the domed portion having substantially the shape of a spherical cap. In particular, the domed portion is a substantially hemispherical domed portion, in which case the radome comprises a substantially cylindrical or slightly frusto-conical lower part that has a diameter substantially equal to the diameter of the hemispherical domed portion.

In particular, the distance S is such that the radome-to-dish diameter ratio is less than 1.2, preferably less than 1.1.

In a corresponding exemplary embodiment of an aerial kit comprising a satellite dish, a device according to the invention and a radome, the radome has an external diameter that is only 7% to 13% larger than the dish diameter. For example, 65, 96, 150 cm dishes can be respectively contained in 72, 104, 170 cm radomes, with no azimuth, elevation, skew movement limitation may be due to the presence of the radome.

Advantageously, the skew axis adjustment means comprises a driving actuating portion integral to the support and a driven actuating portion integral to the dish, the driving and the driven actuating portions cooperating to actuate the rotation of the dish about the skew axis, the driven actuating portion extending within a profile of the dish.

This way, a dish antenna whose dish has a prefixed diameter can be housed inside a radome that is smaller than what is needed if prior art pointing devices are used for adjusting azimuth, elevation and skew angle, since the dish defines a substantially spherical space that has substantially the centre point as the domed portion of the radome, and is closely homothetic with respect to the domed portion. In particular, skew angle adjusting means do not need any additional space beyond the dish outside diameter, as in prior art devices of JP61126803.

Moreover, feed active components, i.e. OMT and LNB converter can be easily arranged behind the dish, i.e., close to convex side of it, which allows a Cassegrain feed arrangement. This solution is much more preferable in the case of a movable dish, in particular in the case of a dish that must in real time compensate for sea wave-induced oscillations to keep on the connection between the antenna and a satellite or a remote sender/receiver, since no cabling must be provided at focus position where adjusting movements reach a maximum value.

Furthermore, a dish equipped with such a pointing device is always arranged such that the waves that carry the signal to be received by the dish cross the radome wall substantially normally to it; this way, signal attenuation and aberration are reduced to a minimum, and any residual signal attenuation and aberration is independent from the orientation of the dish; radome-dependent antenna lobe deformation is therefore also negligible.

Preferably, the driving and the driven actuating portions are respectively a driving pulley and a driven pulley, a flexible motion transmitting means arranged between the driving pulley and the driven pulley such that a rotation of the driving pulley causes a corresponding rotation of the driven pulley. A similar embodiment of the dish position adjusting means may be used for adjusting the elevation and azimuth angles. This way, a smooth and stable adjusting motion can be obtained by means of a cheap adjusting means.

In alternative, the driving and the driven actuating portions are a couple of mutually engaging friction wheels.

In alternative, but not exclusively, the driving and the driven actuating portions are a couple of mutually engaging gears.

Advantageously, the driving and the driven actuating portions are suitable to adjust said skew angle from a position from at least 20° to a position at least −20° to said dish transverse axis with respect to said support transverse axis.

Advantageously, the distance between each axis and the reference point is less than 30 millimeters. In particular, such distance is less than 15 millimeters. Preferably, such distance is zero.

In particular, the reference point is located proximate to a longitudinal axis of the radome.

Preferably, at least two axes selected from the group comprised of the azimuth axis, the elevation axis and the skew axis intersect at the reference point.

Advantageously, the common reference point substantially coincides with a centre point of a domed portion of the radome, the domed portion having substantially the shape of a spherical cap.

In particular the dish crosses the reference point.

In the case of a substantially plane dish, a further reduction is possible of the difference between radome diameter and dish diameter, such that a gap S as narrow as one centimeter can be left between the radome and the space region defined by the dish during an adjusting motion, which further reduces radome encumbrance.

Advantageously, An aerial kit comprises furthermore a basement integral to the support of the dish antenna. The basement has preferably a substantially cylindrical or slightly frusto-conical lower part, whose height is preferably set between 10 and 30 millimeters, and a frusto-conical upper part which is provided with a connection member that can engage with a corresponding connection member of the radome, that is removable from the basement.

In particular, the dish antenna is a satellite dish, and a program means is provided for selecting a dish pointing orientation according to mutually dependent azimuth and elevation angles such that said pointing axis is directed towards a geostationary satellite that is located in the Clarke belt.

BRIEF DESCRIPTION OF THE DRAWINGS

The invention will be now shown with the following description of an exemplary embodiment thereof, exemplifying but not limitative, with reference to the attached drawings in which.

DESCRIPTION OF PREFERRED EXEMPLARY EMBODIMENTS

Figure 1:
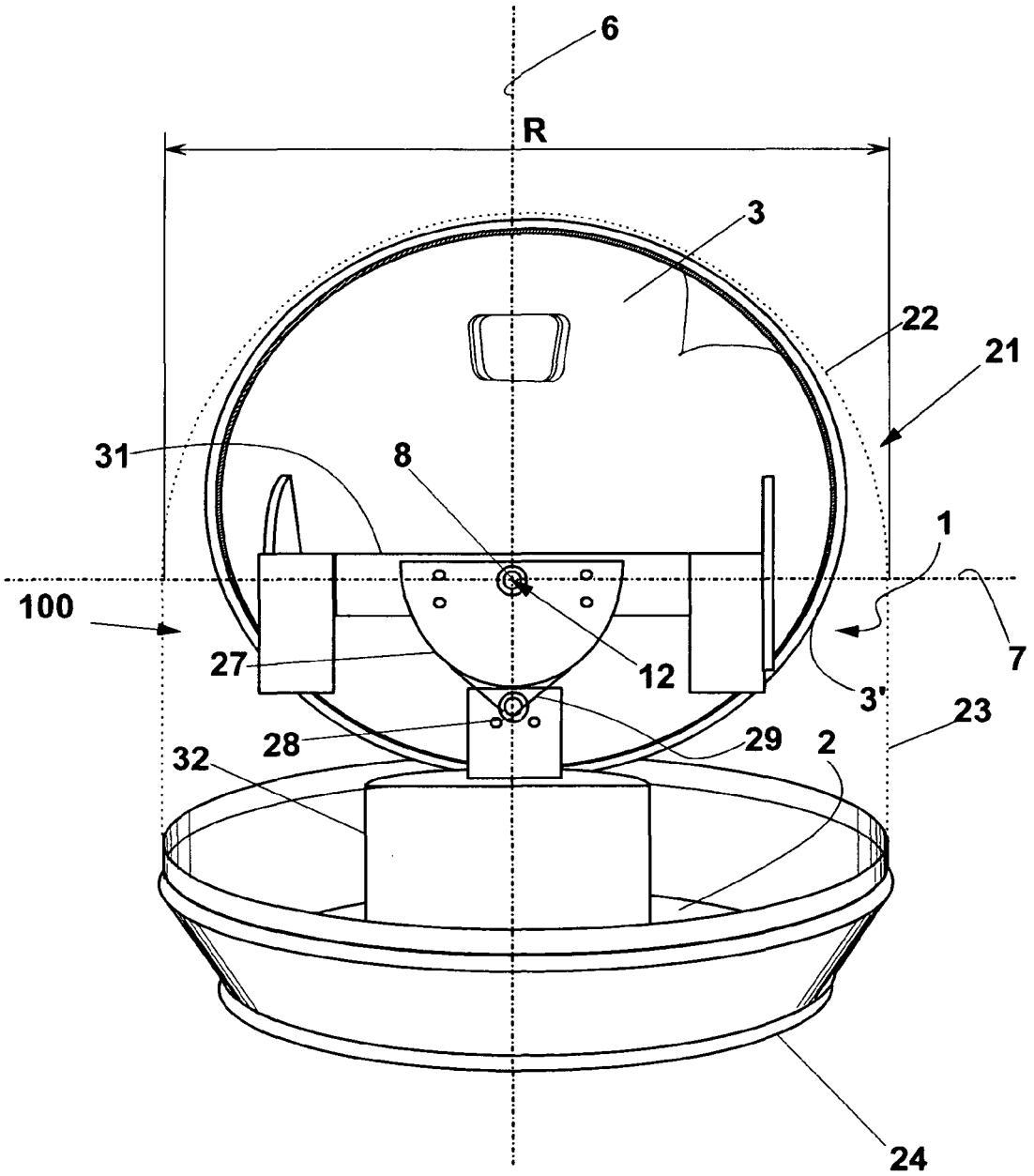
FIG. 1 shows a rear view of a dish satellite antenna provided with a pointing device according to the invention.
Figure 2:
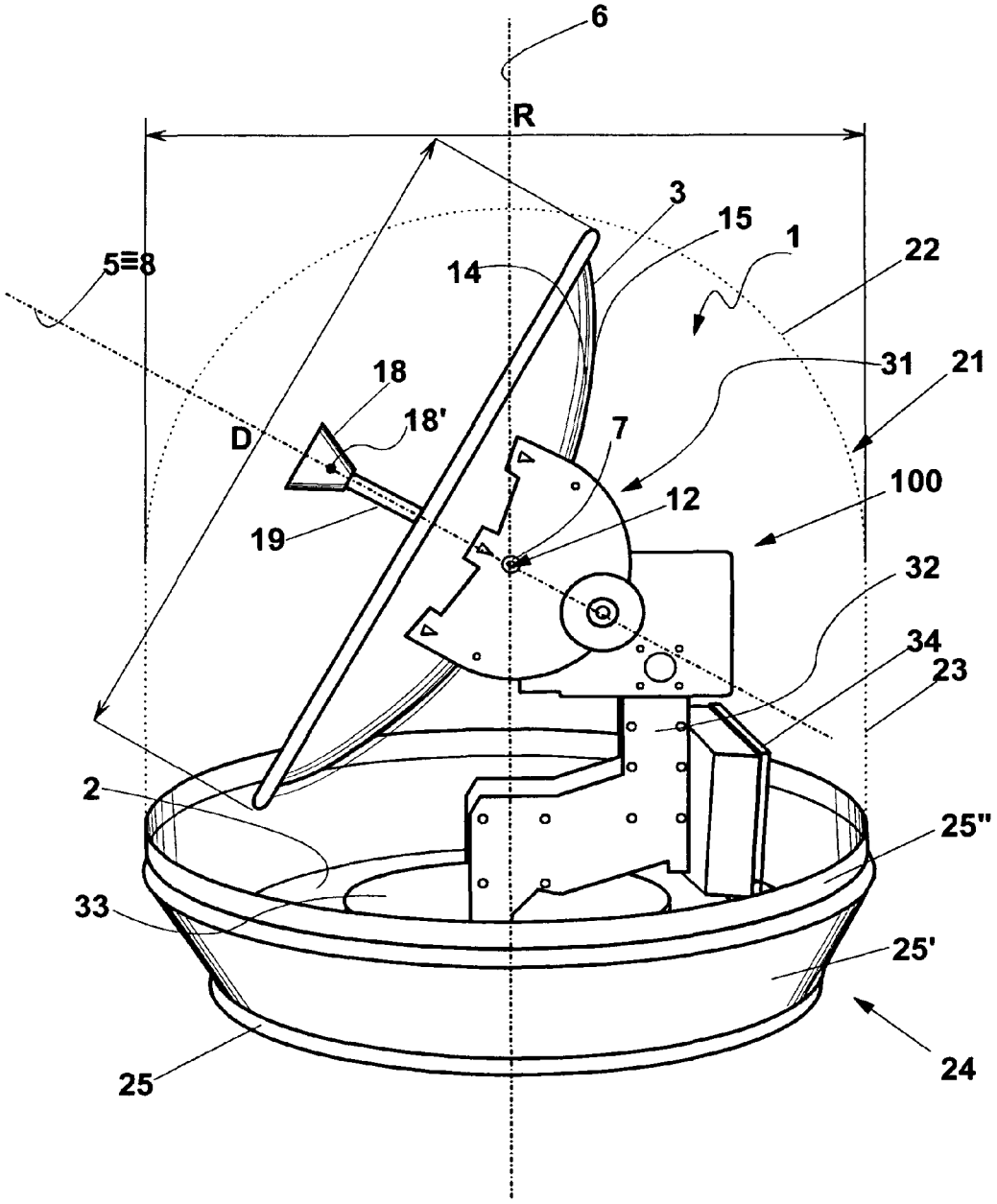
FIG. 2 shows a side view of the dish antenna of FIG. 1.
Figure 4:
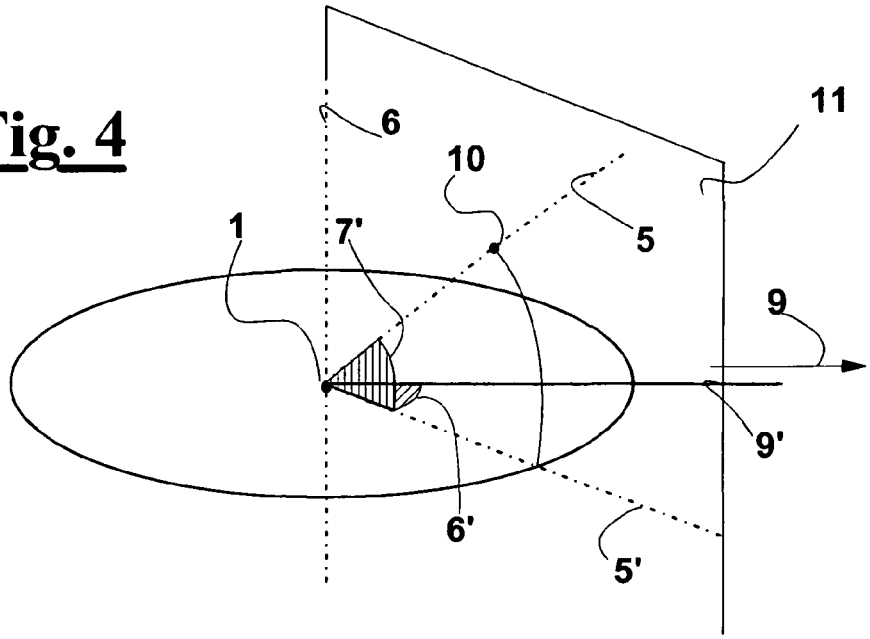
FIG. 4 shows schematically the azimuth angle and the elevation angle to be adjusted by means of the device according to the invention.

With reference to FIGS. 1, 2 and 4, a dish antenna 1 is shown that comprises:

- a dish 3 which has a rear side 15, a front side 14 in use directed towards a remote receiver/sender 10 according to a pointing axis 5 (FIG. 4);
- a support 2;
- a pointing device 100 which is provided with a dish position adjusting means suitable for carrying out respective rotations about three axes. The position of dish antenna 1 with respect to remote sender/receiver 10, apart from the mutual distance can be defined by azimuth angle δ' and elevation angle 7'. Accordingly, rotations of dish 3 are provided about:
  - an azimuth axis 6 integral to support 2, to adjust an azimuth angle δ' formed between pointing axis 5 and a prefixed reference cardinal direction 9' (FIG. 4);
  - an elevation axis 7 integral to dish 3, to adjust an elevation angle 7' formed between pointing axis 5 and a predetermined line 5' that lies on the plane 11 defined by pointing axis 5 and by azimuth axis 6 (FIG. 4).

In the case of a mobile dish antenna that is mounted on a vehicle, such as a watercraft, a steady communication is only possible if a device is provided for real-time pointing dish 3 and pointing axis 5 with respect to remote emitter/receiver 10, for real time adjusting azimuth and elevation angles. Real time adjustment is provided for by a program means that is resident in a control unit, not shown. The control unit is suitable for sending to an actuating means a control signal for modifying on real time the azimuth and/or elevation angle δ',7', responsive to a position signal that is read by the program means from a dish 3 absolute position sensor, not shown, and/or responsive to an intensity signal suitable for indicating to the program means whether the dish is losing the proper orientation.

In case dish antenna 1 is a satellite dish antenna, said program means is suitable for allowing the selection of a prefixed orientation among a plurality of positions, in which azimuth and elevation angles are correlated, such that said pointing axis 5 is directed towards a geostationary satellite that is located in the Clarke's belt.

Still in the case of a mobile antenna, a real-time adjustment of a third angle, i.e. a skew angle 8' is also desirable; for a marine dish antenna, in particular a marine satellite dish, the real-time skew adjustment is strictly necessary, in order to instantaneously compensate for roll and pitch watercraft motions. Therefore, a third real-time rotation is provided about:

- a skew axis 8 integral to dish 3, to adjust a skew angle 8' angle formed between a dish transverse axis 16 integral to dish 3 and a support transverse axis integral 17 to support 2.

A rotation about a third axis, for instance about skew axis 8', is also useful to keep the correct orientation of the receiving unit, responsive to the wave polarisation that is used by the satellite.

Dish antenna 1 is adapted to be contained in a radome 21, whose domed portion 22 is indicated in dotted line in FIG. 1 and, as well in FIGS. 5 to 9.

Figure 3A:
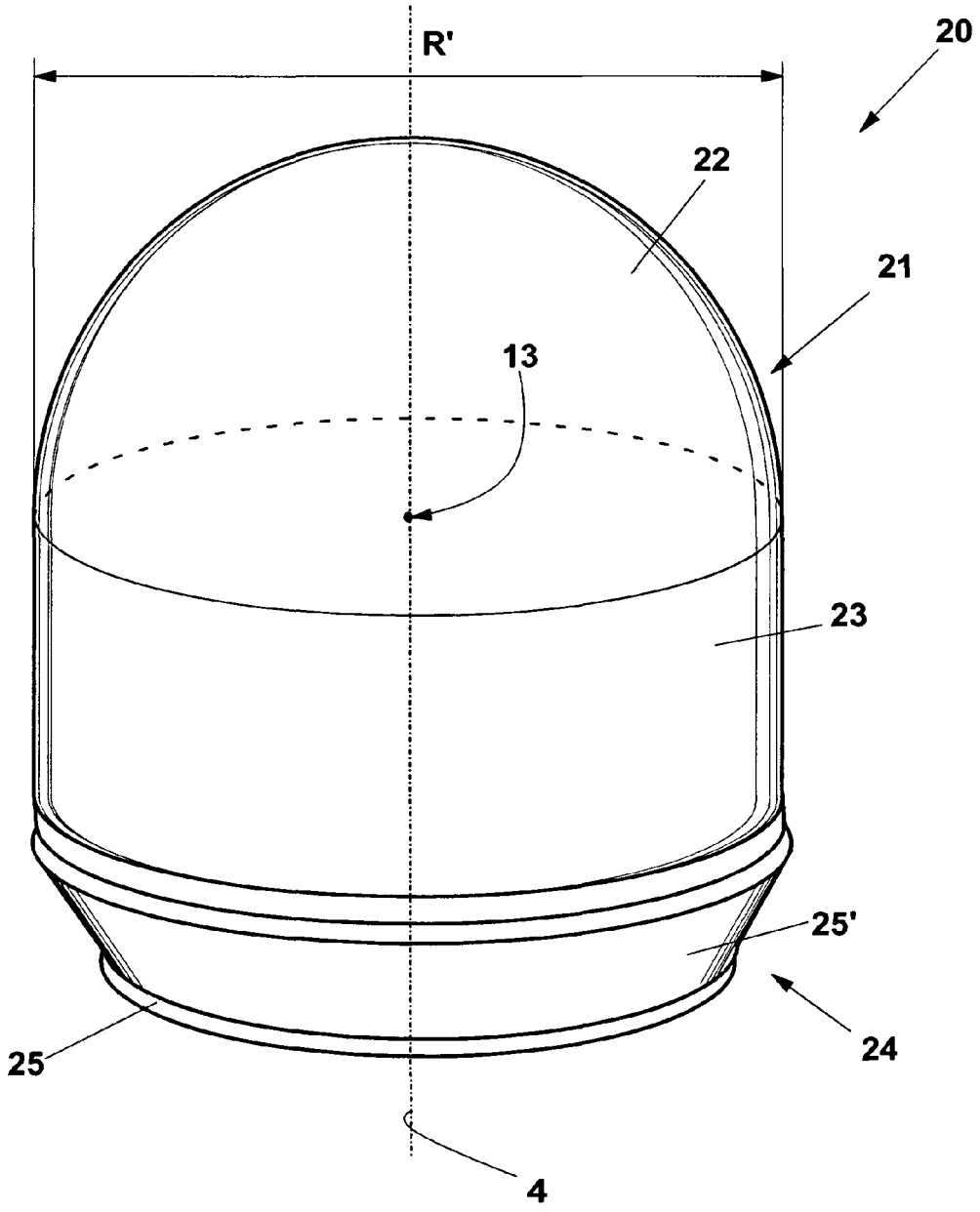
FIGS. 3A and 3B are side views of two different kits each comprising a radome and a satellite dish antenna provided with the pointing device according to the invention.
Figure 3B:
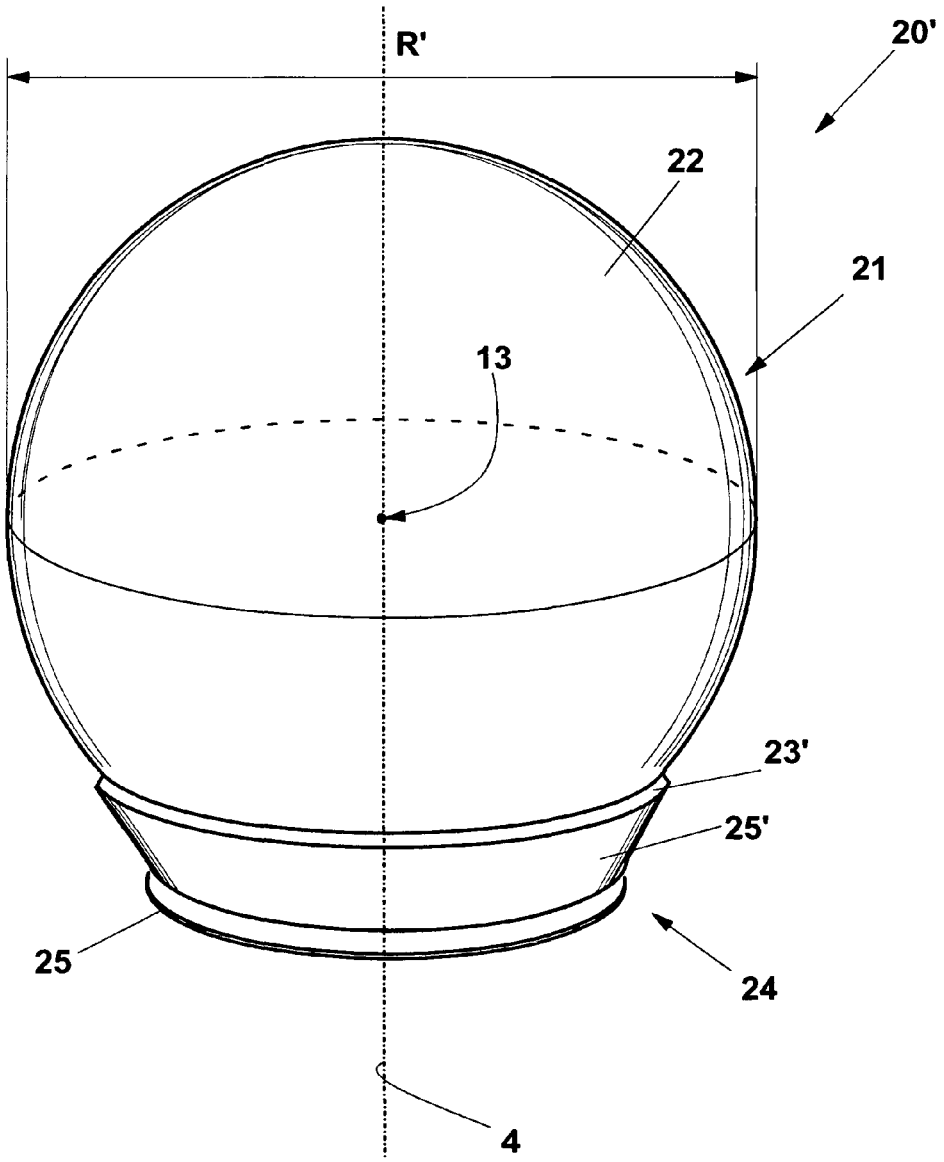

FIG. 3A shows a kit 20 formed by dish antenna 1 and radome 21 that has a substantially hemispherical domed upper portion 22 and a substantially cylindrical or slightly frusto-conical lower portion 23 of the same diameter as hemispherical portion 22. In FIG. 3B a similar kit 20' is shown, in which radome 21 has the shape of a spherical cap connected with a small collar 23'.

In both cases, a basement 24 integral to support 2 is provided, which has a lower cylindrical or toroid-shaped base collar 25, whose height is preferably comprised between 10 and 30 mm, and an upper frusto-conical part 25' which is provided with a connection member 25" (FIG. 2) suitable for engaging with a corresponding connection member of radome 21.

Figure 5:
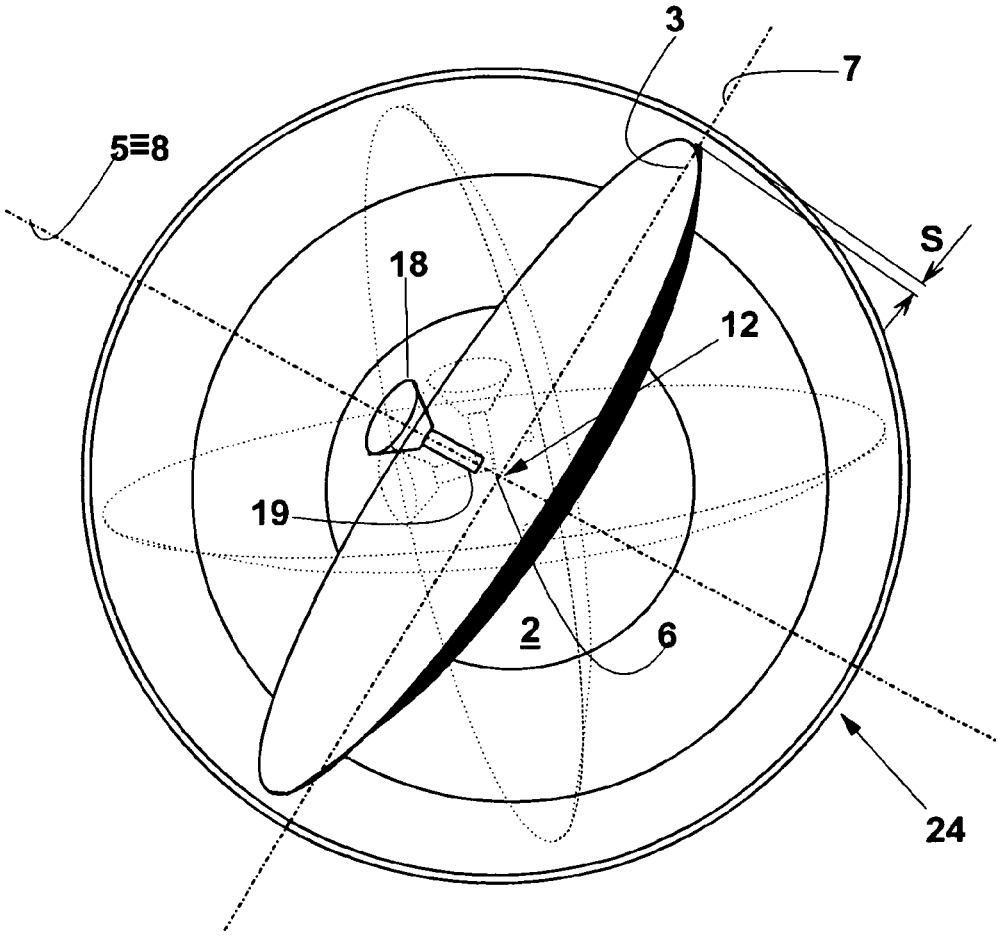
FIG. 5 is a top plan view of the satellite dish antenna of FIGS. 1 and 2 which schematically shows an azimuth adjusting motion.
Figure 6:
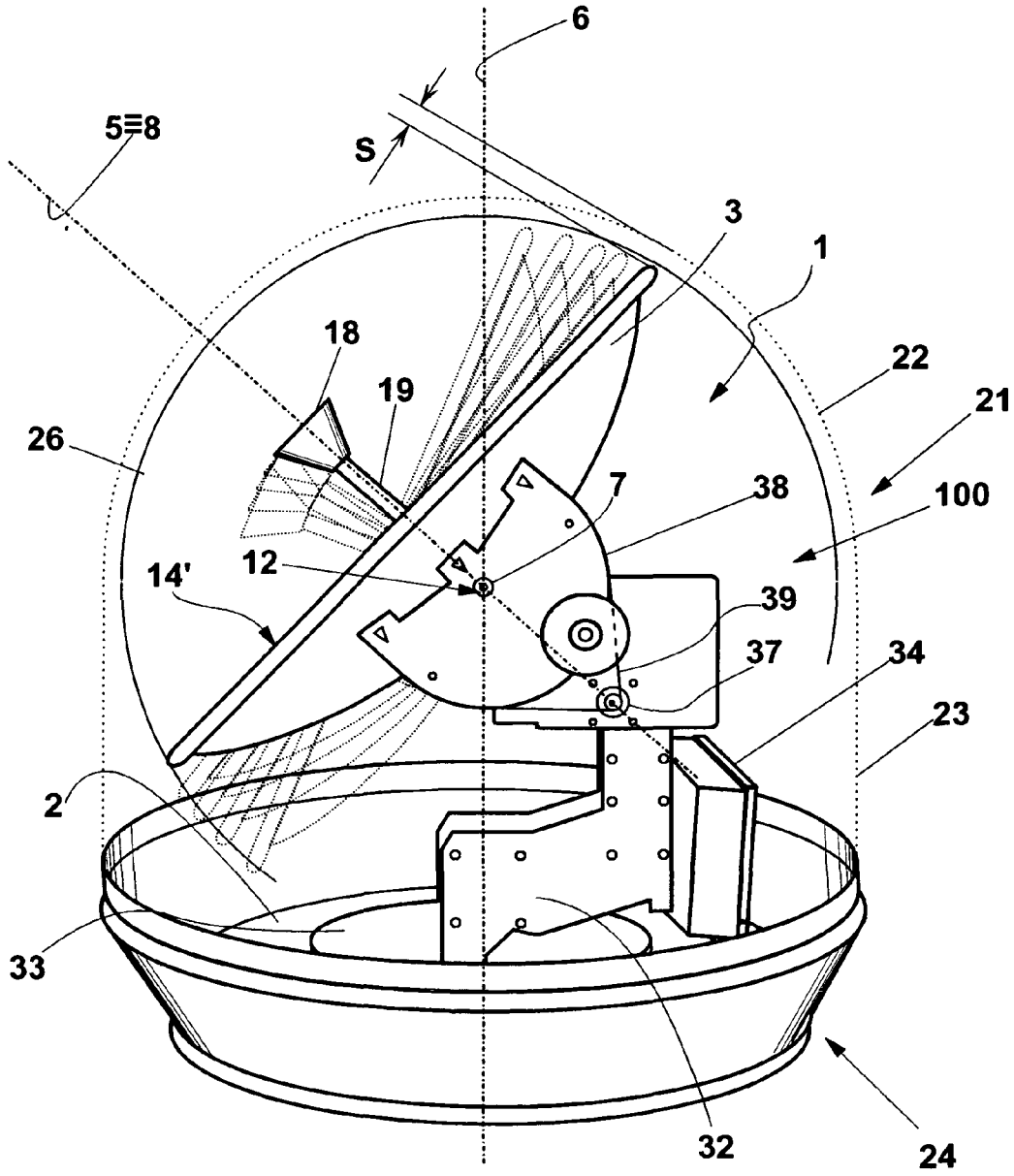
FIG. 6 schematically shows an elevation adjusting motion of the satellite dish antenna of FIGS. 1 and 2.

With reference to FIGS. 5 to 7, azimuth axis 6, elevation axis 7 and skew axis 8 approach very closely to a reference point 12, such that during an adjusting motion dish 3 defines a portion of a substantially spherical space region 26 that is centred about reference point 12 and is contained within radome 21.

Figure 9:
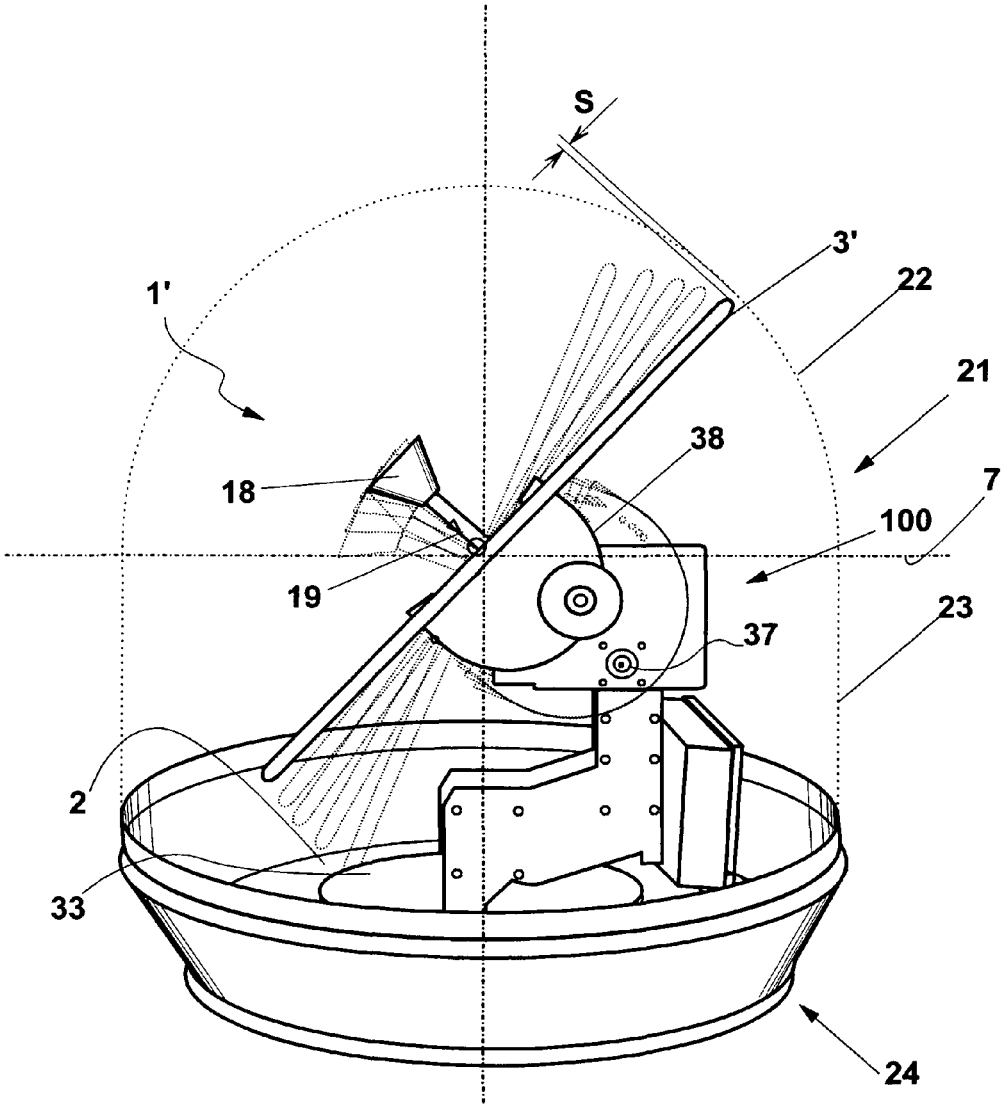
FIG. 9 schematically shows an elevation adjusting motion of a satellite dish antenna in which the dish extends along a plane.

A particular feature of the invention is that reference point 12 is located closer to front side 14 than to rear side 15 of dish 3; in other words, reference point 12 is located within the concavity 14' of dish 3, as in the case of FIG. 6, or even closely proximate to the front side of dish 3', as shown in FIG. 9. This way, feed active components, i.e. OMT and LNB converter (not shown) can be easily arranged close to the convex side of dish 3, according to a Cassegrain feed arrangement, in which only such passive, non-cabled components as a secondary reflecting mirror 18 and a waveguide 19 have to be provided at focus 18' of dish 3 (FIG. 2).

Figure 7A:
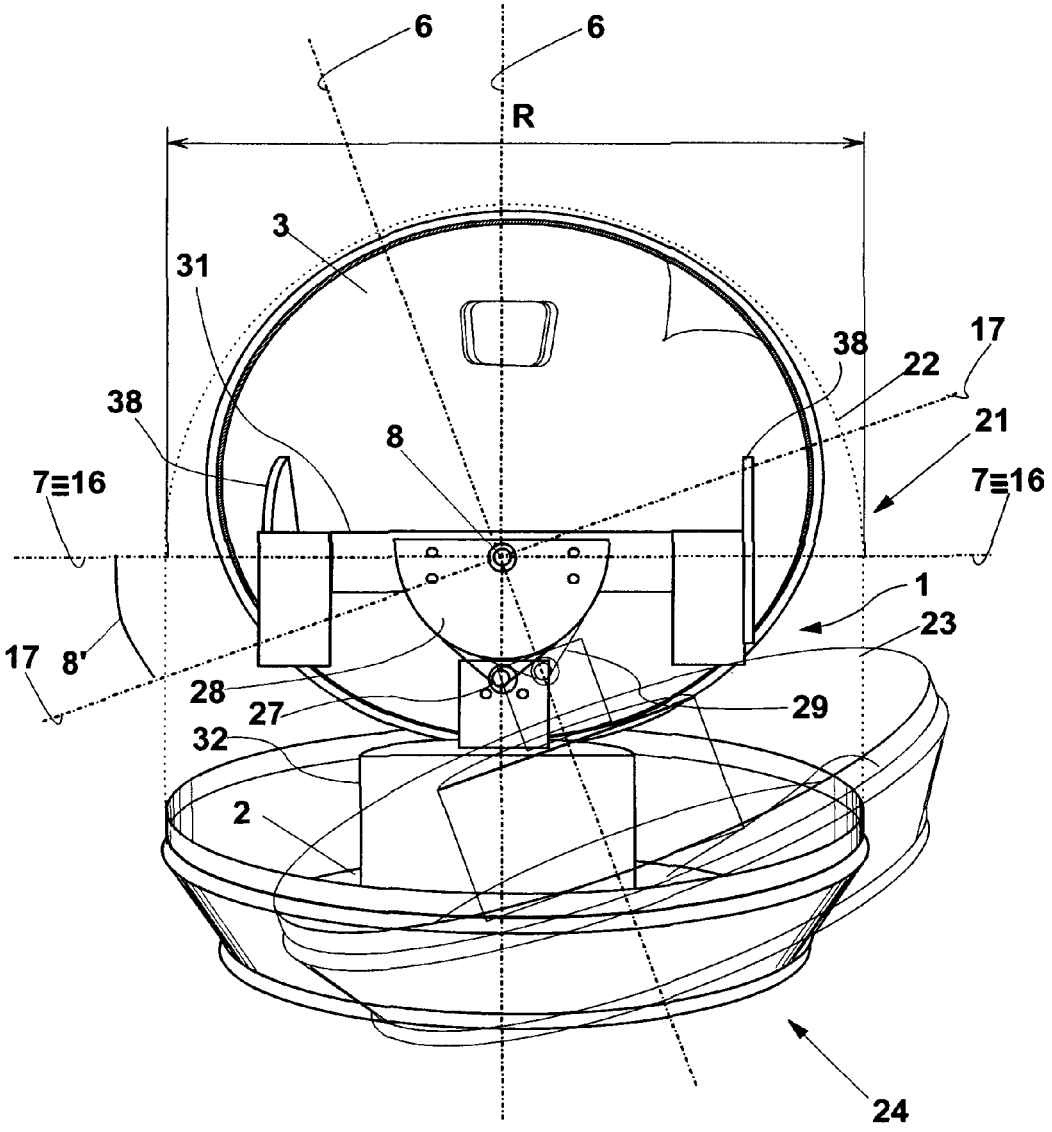
FIG. 7A and FIG. 7B schematically show a skew adjusting motion of the satellite dish antenna of FIGS. 1 and 2.
Figure 7B:
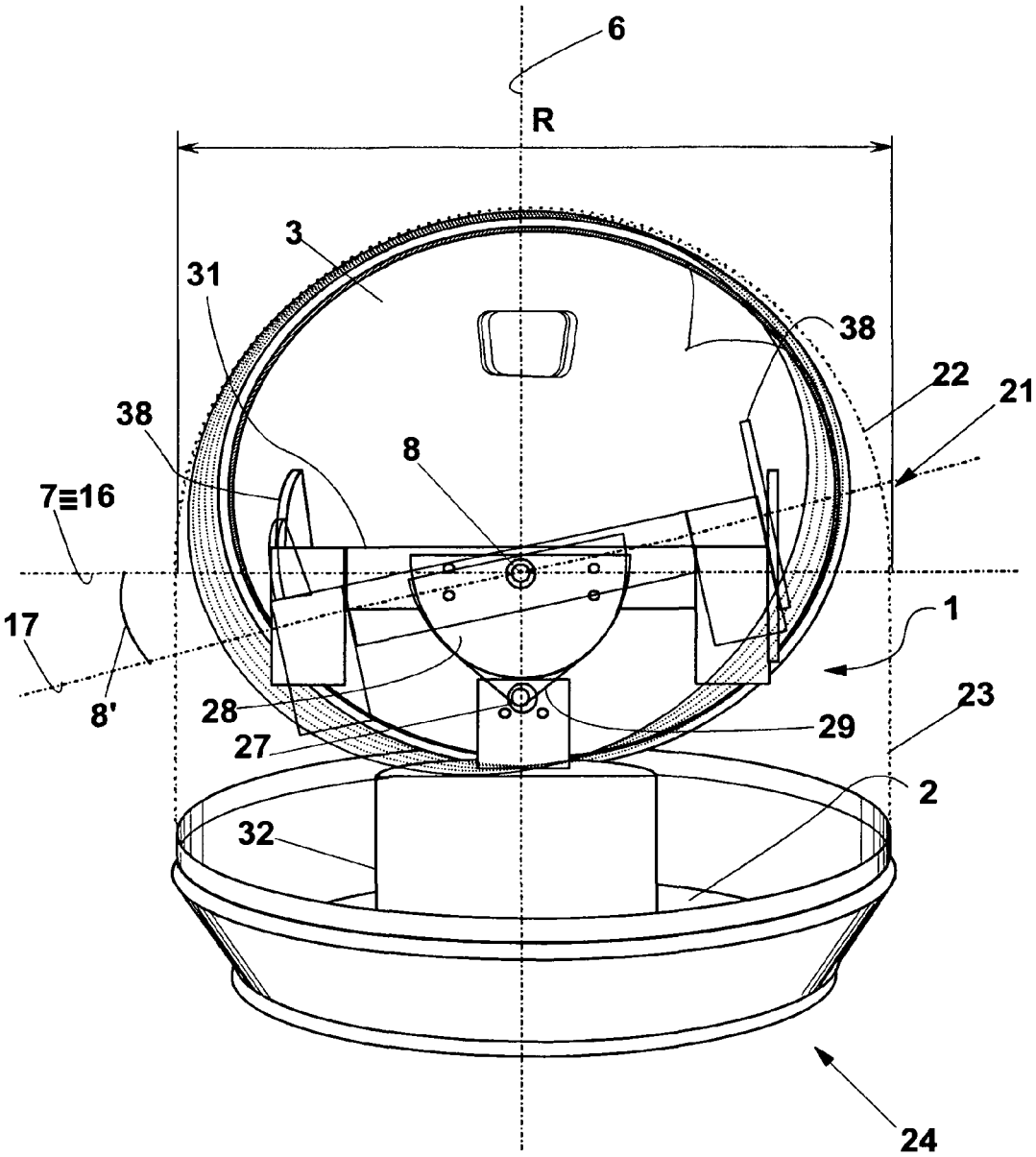

With reference to FIGS. 7A and 7B, to actuate the rotation of dish 3 about skew axis 8, the dish position actuating or adjusting means comprises a driving actuating portion 27 integral to a connection member 32 that joins dish 3 to a rotating platform 33 (FIGS. 2 and 6), and a driven actuating portion 28 integral to dish 3, which cooperates with driving actuating portion 27. FIG. 7A, in particular, shows how a rotation, i.e. a skew angle 8' excursion between −20° and 20° can be provided to compensate for wave-induced roll and/or pitch oscillatory motions, since dish 3 maintains a prefixed position while basement moves integral to a vehicle, in particular to a watercraft surface. For the sake of clearness, only one half of said excursion is shown.

A further particular feature of the invention is that driving actuating portion 27 and driven actuating portion 28, which are located behind dish 3 with respect to remote sender/receiver 10, extend within the profile, i.e. the projection of dish 3. In other words, driving and driven actuating portion 27, 28 are located within the shape of dish 3 with respect to an imaginary, infinitely distant light source that throws its light on front side 14 of dish 3: no part of the dish position adjusting means protrudes beyond the substantially dish 3 circular contour 3', which appears as an ellipse in FIG. 2 due to dish 3 inclination. Accordingly, radome 21 does not need to provide any additional space out of substantially spherical surface 26 defined by any dish 3 adjusting motion, apart from a tolerance or gap S. In other words, radome 21 inner shell closely encircles the space region 26 at least partially defined by dish 3 during the adjusting motion.

In the embodiment of FIG. 7, driving and driven actuating portions 27, 28 are respectively a driving pulley and a driven pulley; a rotation of driving pulley 27 can cause a corresponding rotation of driven pulley 28 by means of a flexible motion transmitting means 29, in particular a belt or a cable. A similar embodiment of the dish position adjusting means may be used for adjusting elevation angle 7', as shown in FIGS. 6 and 9, where a driving pulley 37 and a driven pulley 38 are shown that are linked by a cable or a belt 39 to transmit the movement. Such an arrangement can be obviously be used for adjusting azimuth angle. Similar driving and driven actuating portions, not shown, can be used to adjust azimuth angle δ', i.e to move rotating platform 33 with respect to support 2 about azimuth axis 6, which is represented integral to fixed basement 24 of kit 20 or 20'.

In alternative, but with no limitation, driving and driven actuating portions 27, 28, as well as driving and driven actuating portions 37, 38, may comprise a couple of mutually engaging friction wheels, or a couple of mutually engaging gears, not shown.

The smaller the distances between axes 6,7,8 and reference point 12, the smaller is space region 26, in particular, with dishes whose diameter D ranges between 40 and 150 mm, excellent results are obtained in terms of encumbrance if such distances are lower than 30 or 15 mm. For lower distance, i.e., if the three axes 6,7,8 substantially crosses at reference point 12, reference point 12 lies advantageously on longitudinal axis 4 of radome 21; in particular, reference point 12 coincides with the centre point 13 of substantially hemispherical domed portion 22 of radome 21 (FIG. 3A), or with the centre point of a domed portion 22 which has substantially the shape of a spherical cap (FIG. 3B). In this case, taking into account radome usual thickness, radome 21 has an external diameter D' that is only 7% to 13% larger than the dish diameter R. For example, 65, 96, 150 cm dishes can be respectively contained in 72, 104, 170 cm external diameter radomes, without any limitation for azimuth, elevation, skew motion of dish 3.

Figure 8:
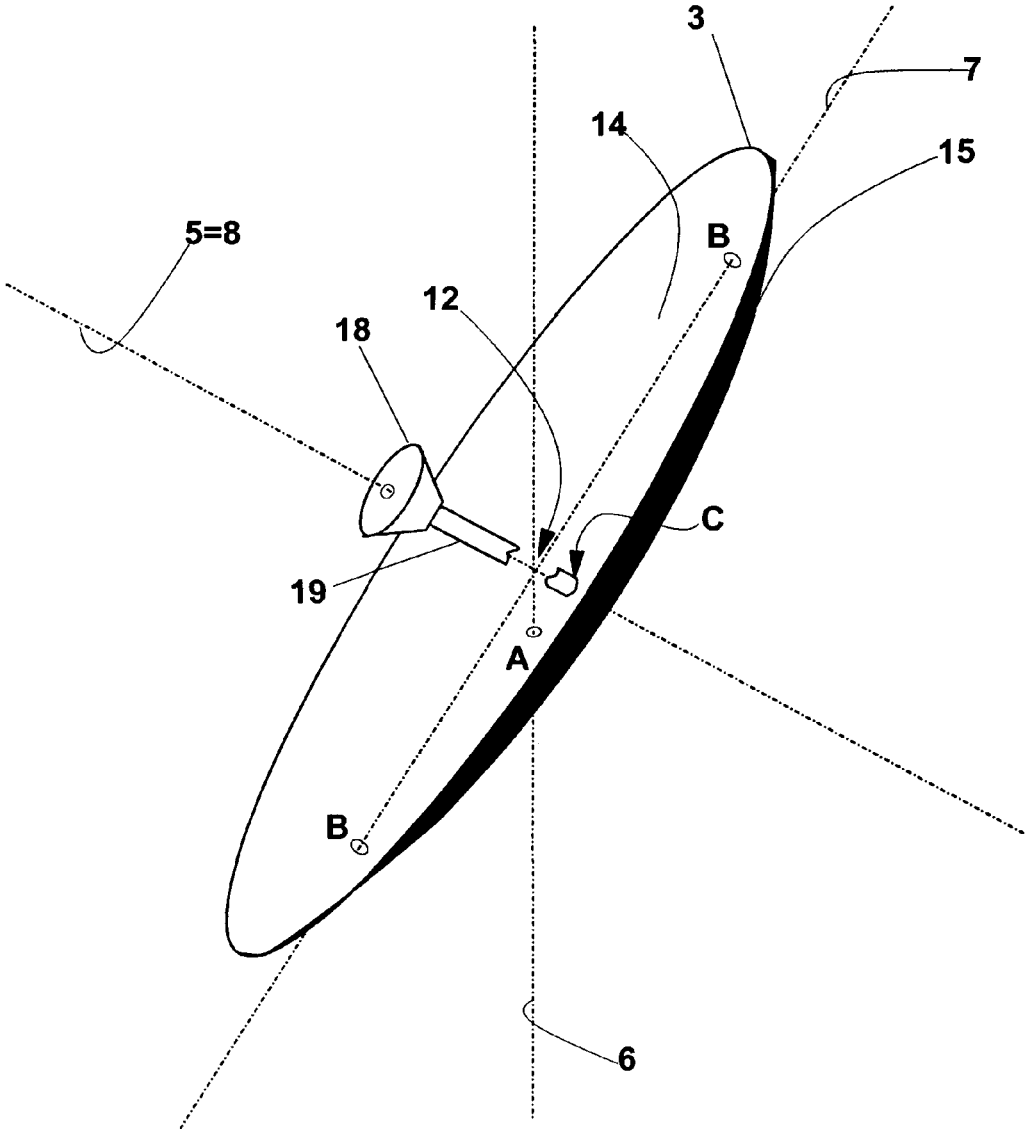
FIG. 8 schematically shows azimuth, elevation and skew axes' positions with respect to the dish of the antenna of FIGS. 1 and 2.

The position of reference point 12 s more clearly represented in FIG. 8, where an elevation axis has a central portion B-B' within the convexity 14' of dish 3, whereas intersection A and C of axes 6 and 8 with dish 3 front side 14 define respective concave side portions and convex side portions of azimuth axis and skew axes 8.

A further reduction is possible of gap S, and therefore of the difference between radome 21 external diameter R' and dish diameter D, if dish 3 itself crosses reference point 12. As shown in FIG. 9, this can be easily made in the case of a substantially plane dish 3'. In the ideal case of FIG. 9, a gap as narrow as one centimeter need to be left between radome 21 and space region 26 defined by dish 3 during an adjusting motion.

Still with reference to FIGS. 1,2 and 5 to 9, a prime-focus dish antenna 1 is considered, since prime focus antennas are normally used in combination with a radome for marine installations or in case of corrosive/erosive atmospheres. In this case, pointing axis 5 coincides with a dish symmetry axis. At any rate, the pointing device according to the invention can be advantageously used in combination with an offset dish antenna, preferably a Gregorian offset dish antenna. An offset dish is normally smaller and less concave than a corresponding prime-focus dish, therefore a further radome size reduction is possible due to reduced dish diameter and to the possibility to arrange the dish closer to reference point 12 than a prime-focus dish, as previously described. In this case, the pointing axis has the direction according to which a wave received from/sent towards remote emitter/receiver 10 is reflected by dish, i.e. the reflecting mirror of the antenna.

Figure 10:
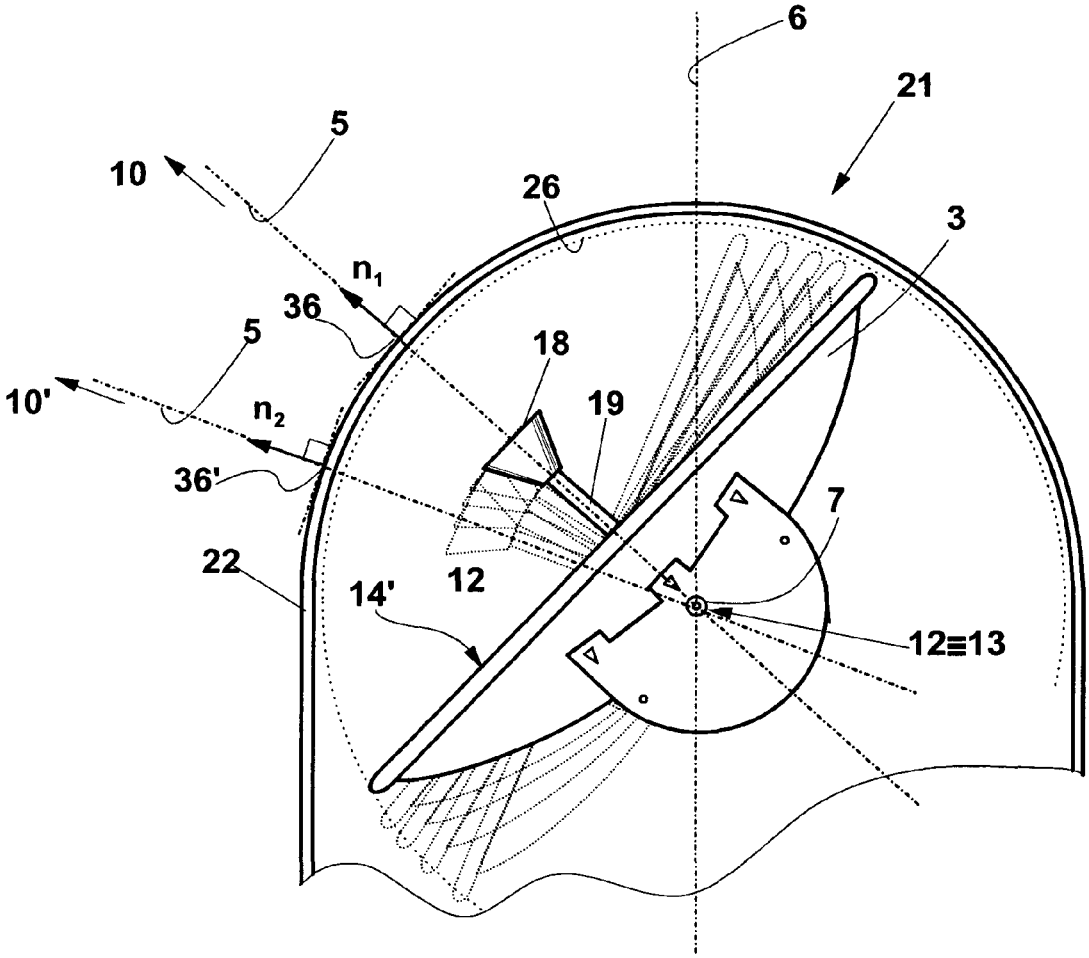
FIG. 10 schematically shows wave propagation direction through a radome of a dish antenna that is provided with a pointing device according to the invention.

As shown in FIG. 10, if reference point 12 of azimuth axis 6, elevation axis 7 and skew axis 8, i.e. centre point of substantially spherical space region 26 coincides with centre point 13 of domed portion 22 of radome 21, the wave propagation direction towards/from remote receiver/emitter 10, 10', which is identified by pointing axis 5 direction is always coincident with respective normal directions $n_1$ and $n_2$ of domed portion 20 at respective points 36, 36'. Accordingly, the pointing device of the present invention allows signal reducing attenuation and aberration to a minimum; any residual signal attenuation and aberration is in any case independent from dish 3 position. Radome-dependent antenna lobe deformation is therefore also negligible. For the sake of clearness this is shown only in case of an elevation adjustment, as in FIG. 10, but it can be obviously reproduced for azimuth and rotations adjustment motions of FIGS. 5 and 7.

The foregoing description of specific embodiments will so fully reveal the invention according to the conceptual point of view, such that others, by applying current knowledge, will be able to modify and/or adapt for various applications such embodiments without further research and without parting from the invention, and it is therefore to be understood that such adaptations and modifications will have to be considered as equivalent to the specific embodiments. The means and the materials to realise the different functions described herein could have a different nature without, for this reason, departing from the field of the invention. It is to be understood that the phraseology or terminology employed herein is for the purpose of description and not of limitation.

The invention claimed is:

1. A pointing device for pointing a dish of a dish antenna in a desired pointing position, said dish having a rear side, a front side that in use is directed towards a remote receiver/sender according to a pointing axis, said dish antenna comprising a radome that has a domed portion with a predetermined diameter (R) such that said dish is contained within said radome in any pointing position of said dish, said pointing device comprising:

an azimuth axis adjustment means, for rotation of said dish about an azimuth axis to adjust an azimuth angle formed between said pointing axis and a prefixed reference cardinal direction;

an elevation axis adjustment means, for rotation of said dish about an elevation axis to adjust an elevation angle formed between said pointing axis and a predetermined line that lies on a plane defined by said pointing axis and by said azimuth axis;

a tilt axis adjustment means, for rotation of said dish about a tilt axis, to adjust a tilt angle formed between a dish transverse axis and a support transverse axis of a support of said dish in such a way to compensate roll and pitch oscillatory motions;

wherein said azimuth axis, said elevation axis and said tilt axis have respective distances from a reference point, such that during an adjusting motion by any of said adjustment means, said dish defines a portion of a space region that is contained within said radome, wherein said distances of the axes from the reference point are less than 30 millimeters, and wherein said reference point is located closer to said front side than to said rear side opposite to said front side, such that the distance between said dish and said radome is less than a determined distance S for any pointing position.

2. A device according to claim 1, wherein said radome comprises a domed portion, said domed portion having substantially the shape of a spherical cap, wherein, in particular, said domed portion is a substantially hemispherical domed portion, and said radome comprises a substantially cylindrical or slightly frusto-conical lower part that has a diameter substantially equal to said diameter of said hemispherical domed portion.

3. A device according to claim 2, wherein said driving and said driven actuating portions are respectively a driving pulley and a driven pulley, flexible motion transmitting means arranged between said driving pulley and said driven pulley such that a rotation of said driving pulley causes a corresponding rotation of said driven pulley.

4. A device according to claim 2, wherein said driving and said driven actuating portions are first and second mutually engaging friction wheels.

5. A device according to claim 2, wherein said driving and said driven actuating portions are first and second mutually engaging gears.

6. A device according to claim 1, wherein said distance S is such that said radome-to-dish diameter ratio is less than 1.2.

7. A device according to claim 1, wherein said radome has an external diameter (R) that is 7% to 13% larger than a diameter (D) of said dish.

8. A device according to claim 1, wherein said tilt axis adjustment means comprises a driving actuating portion integral to said support and a driven actuating portion integral to said dish said driving and said driven actuating portions cooperating to actuate said rotation of said dish about said tilt axis, said driven actuating portion extending within a profile of said dish.

9. A device according to claim 1, wherein, said distances of said axes from said reference point are zero.

10. A device according to claim 1, wherein said reference point is located proximate to a longitudinal axis of said radome.

11. A device according to claim 1, wherein at least two axes selected from the group comprised of said azimuth axis, said elevation axis and said tilt intersect at said reference point.

12. A device according to claim 1, wherein said reference point substantially coincides with a center point of said domed portion of said radome, said domed portion having substantially the shape of a spherical cap.

13. A device according to claim 1, wherein said dish crosses said reference point.

14. A device according to claim 1, wherein said distance S is such that said radome-to-dish diameter ratio is less than 1.1.

* * * * *